US005593022A

United States Patent [19]

Schaeffer et al.

[11] Patent Number: 5,593,022

[45] Date of Patent: Jan. 14, 1997

[54] PUSH-AND-TURN LATCHING CONTROL BUTTON, IN PARTICULAR FOR OPERATING AN ELECTRICAL COMPONENT

[75] Inventors: Maurice Schaeffer; Alain Choukroun, both of Strasbourg, France

[73] Assignee: B A C O Constructions Electriques Anct. Baumgarten, Strasbourg, France

[21] Appl. No.: 383,230

[22] Filed: Feb. 3, 1995

[30] Foreign Application Priority Data

Feb. 14, 1994 [FR] France ..... 94 01616

[51] Int. Cl.[6] ..... H01H 3/20

[52] U.S. Cl. ..... 200/308; 200/318.2

[58] Field of Search ..... 200/308, 318.2, 200/345, 321, 529

[56] References Cited

U.S. PATENT DOCUMENTS

| | | | |
|---|---|---|---|
| 3,721,789 | 3/1973 | Black | 200/167 |
| 4,182,943 | 1/1980 | Butterworth | 200/318.2 |
| 5,055,643 | 10/1991 | Pardini et al. | 200/318.2 |

FOREIGN PATENT DOCUMENTS

| | | | |
|---|---|---|---|
| 2212626 | 7/1974 | France . | |
| 1930861 | 1/1966 | Germany . | |
| 8634102 | 4/1987 | Germany . | |
| 0321502 | 11/1929 | United Kingdom | 200/308 |

*Primary Examiner*—Renee S. Luebke
*Attorney, Agent, or Firm*—Young & Thompson

[57] ABSTRACT

The control member of a push-and-turn type latching control button is associated with a position indicator mobile between a retracted position which is its position when the control member is in an out position and a deployed position which is its position when said control member.

16 Claims, 3 Drawing Sheets

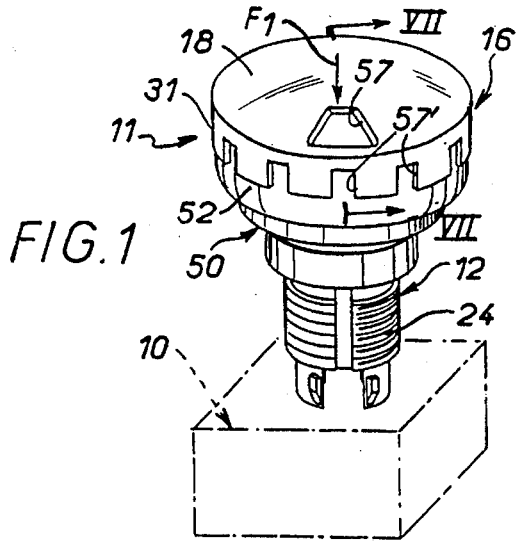
FIG.1
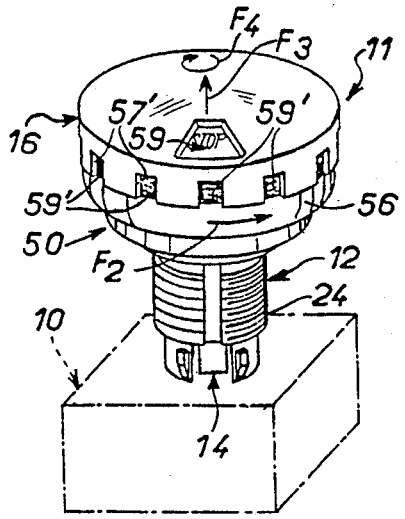
FIG.2
FIG.3
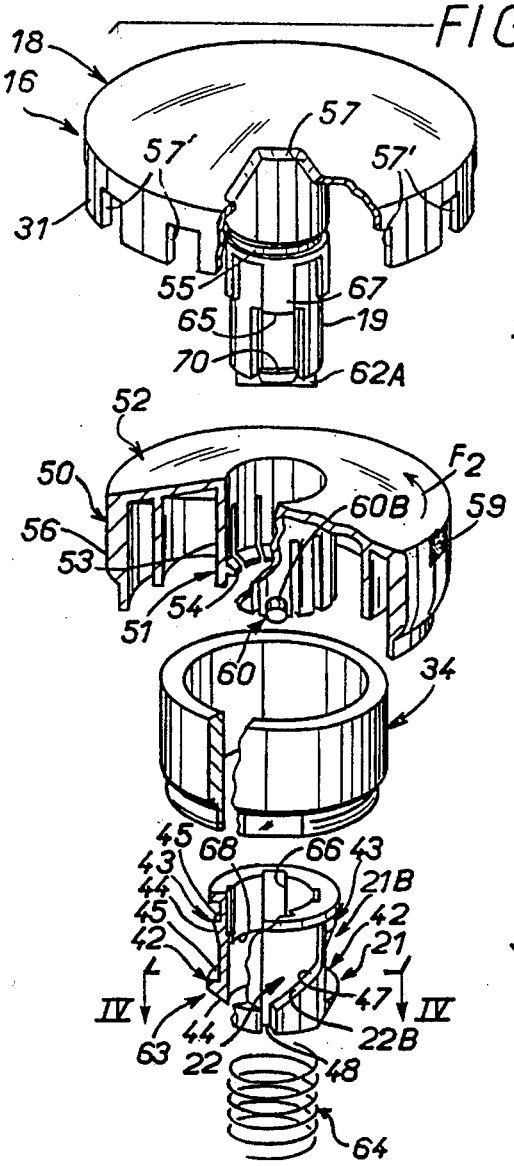
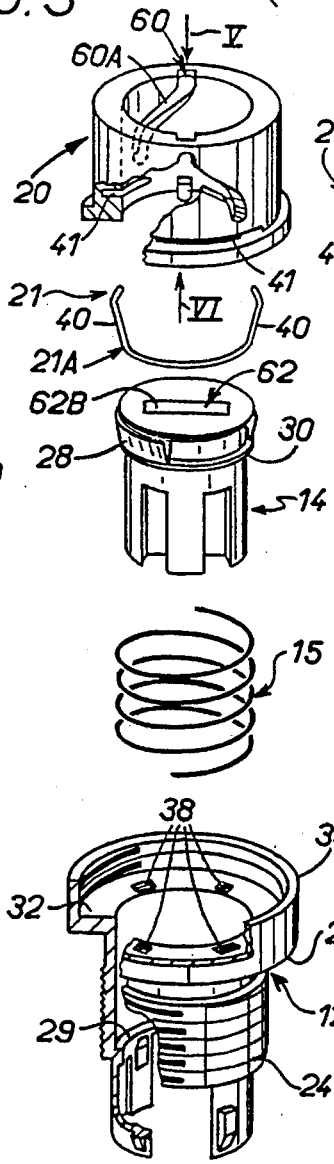
FIG.6
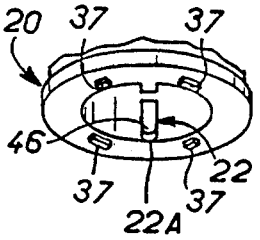

PUSH-AND-TURN LATCHING CONTROL BUTTON, IN PARTICULAR FOR OPERATING AN ELECTRICAL COMPONENT

BACKGROUND OF THE INVENTION

1. Field of the Invention

The present invention is generally concerned with control buttons which must be pressed to operate an underlying component, for example an electrical component.

2. Description of the Prior Art

Usually called "punch buttons" when their shape is such that they can be operated with the palm of the hand, these control buttons usually include a guide body by means of which they can be mounted on a support of any kind, a piston mobile in the guide body against return spring means to operate the underlying component, and a generally mushroom-shaped control member mobile axially relative to the guide body between an "out" inoperative position and an "in" operative position and including a head which is actuated by the user and a spindle acting on the piston and, through the intermediary of the latter, on the underlying component.

The present invention is more particularly concerned with control buttons usually called "push-and-turn latching" control buttons which further include a retaining ring which is fixed relative to the guide body in the axial direction and prevented from rotating relative to the guide body, extends around the spindle of the control member and has, subordinate to the retaining ring, hooking means adapted to hold the control member releasably in the in position when action has been applied to the latter accordingly and cam means adapted to return said control member to its initial angular position when it is released after having been turned in the depressed position to disengage the hooking means.

Control buttons of this kind are used to disconnect equipment semi-permanently, for example.

In some applications at least it would seem desirable for the "in" or "out" position of the control member to be clearly indicated, the travel of the control member between its two positions being usually too small for its position to be determined unambiguously merely by looking at it.

In a first aspect, a general object of the present invention is an arrangement which meets this requirement in a particularly simple and effective manner.

SUMMARY OF THE INVENTION

In a first aspect, the present invention consists in a control button comprising a guide body adapted to be mounted on a support of any kind, a piston adapted to operate an underlying component of any kind and mobile in said guide body against return spring means, a control member mobile axially relative to said guide body between an "out" inoperative position and an "in" operative position and including a head for operation by a user and a spindle for operating said piston, and a retaining ring around said spindle of said control member, fixed axially relative to said guide body and prevented from rotating relative thereto, with, subordinate to said retaining ring, hooking means adapted to hold said control member releasably in its "in" position when action has been applied to the latter accordingly and cam means adapted to return said control member to its original angular position when it is released after being turned in its "in" position to disengage said hooking means, wherein said control member is associated with a position indicator mobile between a retracted position when said control member is in its "out" position and a deployed position when said control member is in its "in" position and at least a portion of which is concealed in its retracted position is revealed in its deployed position.

For example, in a preferred embodiment of the invention, the position indicator rotates about the spindle of the control member and includes a hub around and rotating on the spindle of the control member and keyed axially thereto and a flange under the head of the control member forming a head at least in part complementary to that of the control member and the head of the control member has at least one localized opening such as a window or a notch on the path of movement of the flange, cam means between the position indicator and the retaining ring rotating the position indicator.

Accordingly, depending on whether the control member is "in" or "out", only the appropriately marked portion of the position indicator flange can be seen.

By moving from a retracted position to a deployed position, the position indicator clearly indicates whether the control member is out or in.

For some applications at least it would also seem desirable to prevent return of the control member from its "in" position to its "out" position in response to chance rotation of the control member, for example by someone inadvertently brushing against it.

In a second aspect of the invention, the control button further includes, to meet this requirement, locking means adapted to releasably lock the control member in the depressed position when action has been applied to the latter accordingly. The locking means can be any of a large number of suitable devices.

To release the control member it is then necessary to pull on it before or after rotating it to return it from its in position to its out position, for example.

Alternatively, it is necessary to depress a pushbutton provided for this purpose on the spindle of its control member.

In all cases positive and deliberate action is advantageously required.

The features and advantages of the invention will emerge from the following description given by way of example and with reference to the appended diagrammatic drawings.

BRIEF DESCRIPTION OF THE DRAWINGS

FIG. 1 is a perspective view of a control button of the invention showing its control member in its "out" position.

FIG. 2 is a perspective view showing the control member in its "in" position.

FIG. 3 is a locally cut away exploded perspective view to a larger scale of the control button of the invention.

FIG. 6 is a perspective view of part of this other component, as seen from underneath, in the direction of the arrow VI in FIG. 3.

DETAILED DESCRIPTION OF THE PREFERRED EMBODIMENTS

As shown diagramatically in FIGS. 1 and 2, the objective is to operate any component 10, for example any electrical component, for example a switch.

Figure 7:
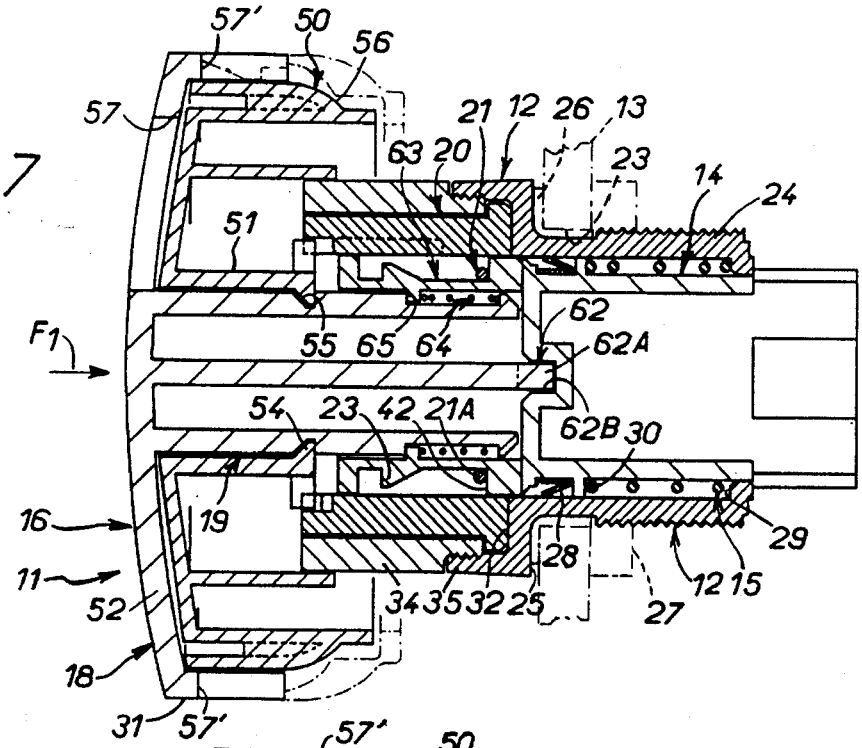
FIG. 7 is a view of the control button of the invention in axial section on the line VII—VII in FIG. 1 and to a larger scale, showing the control member in the out position.

The component 10 is operated by a control button 11 which has a guide body 12 by means of which it can be mounted in any kind of support 13, as shown in chain-dotted outline in FIG. 7, a piston 14 mobile in the guide body 12 against return spring means 15, which in the embodiment shown comprise a coil spring, to operate the underlying component 10, a control member 16 which is generally mushroom-shape and mobile axially relative to the guide body 12 between an "out" inoperative position (FIGS. 1 and 7) and an "in" operative position (FIGS. 2 and 8) and having a head 18 which is actuated boby the user and a spindle 19 for acting on the piston 14, a retaining ring 20 fixed axially relative to the guide body 12 and prevented from rotating relative to the latter, extending around the spindle 19 of the control member 16 and having, subordinate to the retaining ring 20, by virtue of arrangements described in more detail below, hooking means 21 adapted to retain the control member 16 releasably in the depressed position when action has been applied to the latter accordingly and cam means 22 adapted to return the control member 16 to its initial angular position when it is released after being the underlying component 10, a control member 16 which is generally mushroom-shape and mobile axially relative to the guide body 12 between an "out" inoperative position (FIGS. 1 and 7) and an "in" operative position a screwthreaded portion 24 of the guide body 12 is inserted.

A shoulder 25 on the guide body 12 presses a gasket 26 against the support 13. A nut 27 is screwed onto its screwthreaded portion 24 to lock it in position on the support 13.

In the embodiments shown the piston 14 carries an annular seal 28, in practise a lip seal.

The return spring means 15 bear at one end on an internal shoulder 29 of the guide body 12 and at the other end against an external shoulder 30 on the piston 14.

In the embodiments shown the head 18 of the control member 16 has a circular contour (as seen in plan view) and includes a peripheral skirt 31.

The retaining ring 20 is pressed against a shoulder 32 on the guide body 12 by a bush 34 screwed into a screwthreaded portion 35 of the guide body 12.

To lock it against rotation on the guide body 12 the retaining ring 20 has projecting lugs 37 engaged with complementary openings 38 in the shoulder 32 of the guide body 12.

The hooking means 21 comprise a part 21A which relates to the retaining ring 20 and a part 21B which relates to the control member 16.

The part 21A is a U-shape clip whose lateral branches 40 are engaged transversely on the retaining ring 20 by means of holes 41 on the inside wall of the ring 20 and having a depth equal to half its thickness.

Figure 5:
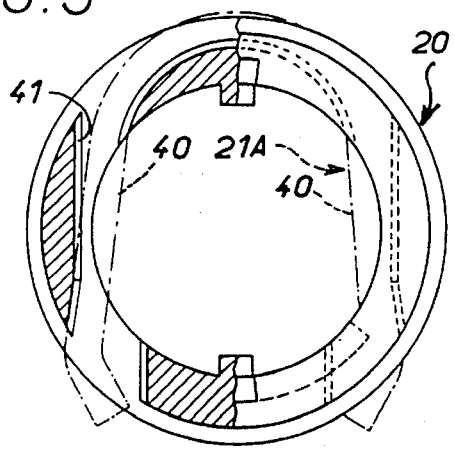
FIG. 5 is a partly cut away top view of another component as seen in the direction of the arrow V in FIG. 3.

When the clip constituting part 21A of the hooking means 21 is engaged with the retaining ring 20 its lateral branches 40 project slightly into the interior volume of the latter, as shown in chain-dotted outline in FIG. 5.

The part 21B of the hooking means 21 relating to the control member 16 comprises two pairs of lugs 42, 43 staggered in the heightwise direction and rotating with the spindle 19 of the control member 16. The lugs 42 retain the control member 16 in the "out" position and the lugs 43 retain it in the "in" position.

The lugs 42 have an oblique flank 44 on the side opposite the head 18 of the control member 16 so that, during assembly, they can push aside the lateral branches 40 of the clip forming the part 21A of the hooking means 21 (by virtue of simple temporary elastic deformation of the lateral branches 40); they have a straight flank 45 on the same side as the head 18 of the control member 16.

In practice the same applies to the lugs 43.

The cam means 22 are also in two parts, comprising a part 22A relating to the retaining ring 20 and a part 22B relating to the control member 16.

The part 22A comprises two lugs 46 projecting radially from the inside of the retaining ring 20, in diametrally opposite positions.

The part 22B includes two corresponding helical ramps 47 rotating with the spindle 19 of the control member 16 and each communicating at the end opposite the head 18 of the control member 16 with an elongate groove 48 parallel to the axis of the assembly.

The preceding arrangements are well known in themselves and accordingly will not be described further here.

In accordance with the invention, a position indicator 50 associated with the control member 16 is mobile between a retracted position (FIGS. 1 and 7) which is its position when the control member 16 is in the "out" position and a deployed position (FIGS. 2 and 8) which is its position when the control member 16 is in the in position; at least a part of it which is concealed in the retracted position is revealed in the deployed position.

In the embodiments shown the position indicator 50 rotates about the spindle 19 of the control member 16.

It has a hub 51 around the spindle 19 of the control member 16, to which it is keyed so that it moves axially with the spindle, and a flange 52 under the head 18 of the control member 16.

In the embodiments shown the hub 51 is divided into lugs 53 each having projecting from its inside surface, near its free end, a lug 54 engaged in an annular groove 55 provided for this purpose on the spindle 19 of the control member 16.

In the embodiments shown the flange 52 forms a head which is at least in part complementary to the head 18 of the control member 16 and which, like the latter, has a peripheral skirt 56.

In the embodiment shown in FIGS. 1 through 8 the position indicator 50 is in one piece, but this is not necessarily the case, as will emerge below.

In accordance with the invention, the head 18 of the control member 16 includes at least one opening 57, 57' such as a window 57 or notch 57' on the path of movement of the flange 52 of the position indicator 50, through which the position indicator 50 can be seen.

In the embodiment shown in FIGS. 1 through 8 the head 18 of the control member 16 has an isolated opening 57 in its front wall forming a closed contour window and a plurality of openings 57' equi-angularly distributed around its skirt 31.

As shown in continuous outline, the openings 57' are notches with an open contour because, in this embodiment, the skirt 31 of the head 18 of the control member 16 is shallow.

As an alternative to this, however, as shown in chain-dotted outline in FIG. 7, the skirt 31 can have a height sufficient for the head 18 of the control member 16 to cover entirely the flange 52 of the position indicator 50, which has the advantage of barring access to the skirt 56 of the latter.

In this case, like the opening 57, the openings 57' are closed contour windows.

If required, the openings 57, 57' are closed by translucent inserts (not shown) to minimize the risk of soiling of the position indicator 50.

In corresponding relationship to the opening 57, and on the same circumference as the latter, the flange 52 of the position indicator 50 includes a marker 59 which is concealed in the "out" position of the control member 16 (FIG. 1) and revealed in its in position (52).

This indicator is the word "STOP", for example, as shown here.

In corresponding relationship to the openings 57', and on the same circumference as the latter, the flange 52 of the position indicator 50, to be more precise the skirt 56 of the flange 52, has an equal number of markers 59', as shown in FIG. 2.

These are colored markers, for example.

Cam means 60 for rotating the position indicator 50 are provided between the position indicator 50 and the retaining ring 20.

In the embodiments shown the cam means 60 include at least one helical groove 60A on the inside surface of the retaining ring 20 with an open end parallel to the axis of the assembly at the same end as the head 18 of the control member 16 and at least one lug 60B in corresponding relationship thereto on the position indicator 50, projecting radially from the base of the hub 51 of the position indicator 50 and engaged with the helical groove 60A in the retaining ring 20.

In practise two diametrally opposed helical grooves 60A and two corresponding lugs 60B are provided.

In the embodiment shown in FIGS. 1 through 8 and in the embodiment shown in FIGS. 11 through 16 the control button 11 of the invention further includes locking means adapted to lock the control member 16 releasably in its "in" position when action has been applied to the latter accordingly.

In the embodiment shown in FIGS. 1 through 8 these locking means include complementary nesting means 62 operative, as described below, axially between the spindle 19 of the control member 16 and the piston 14 and the part 21B of the hooking means 21 relating to the control member 16 is carried by a bush 63 around the spindle 19 of the control member 16 rotating with and mobile on the spindle 19 and cooperating with bias spring means 64, in a practise a coil spring, bearing on the spindle 19 of the control member 16 and spring-loading the bush 63 towards a transverse shoulder 65 on the spindle 19 facing away from the head 18 of the control member 16.

In the embodiment shown the nesting means 62 include a diametral rib 62A at the end of the spindle 19 of the control member 16 and a corresponding complementary diametral groove 62B on the piston 14.

The bush 63 has grooves 66 on its inside surface parallel to the axis of the assembly and engaged with corresponding ribs 67 on the spindle 19 of the control member 16.

A transverse shoulder 68 projects from the inside surface of the bush 63. One end of the bias spring means 64 bears against this shoulder.

The spindle 19 of the control member 16 has a transverse shoulder 70 projecting from its external surface. The other end of the spring bias means 64 bears against this shoulder.

In addition to the lugs 42, 43 forming the part 21B of the hooking means 21 relating to the control member 16, the bush 63 has on its outside surface helical ramps 47 forming the part 22B of the cam means 22 operative between the control member 16 and the retaining ring 20.

Figure 4:
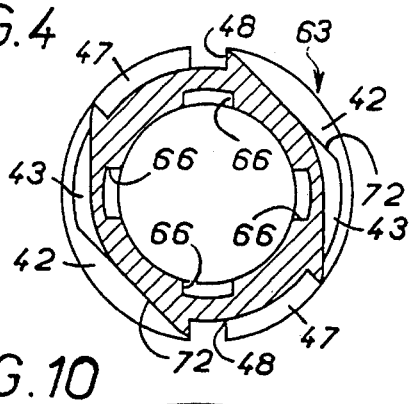
FIG. 4 is a view of one component of this control button in transverse section on the line IV—IV in FIG. 3 and to a different scale.

As can be seen clearly in FIG. 4, it has flaps 72 on its outside surface alternating with the lugs 43, offset circumferentially from the lugs 43, but facing the lugs 42 which subtend a greater angle than the lugs 43.

In the out position of the control member 16 (FIGS. 1 and 7) the clip constituting the part 21A of the hooking means 21 is engaged with the lugs 42 of the bush 63, which keys the bush 63 to the retaining ring 20 and therefore to the guide body 12 in the axial direction.

The return spring means 15 keep the piston 14 in the raised position, abutted against the bush 63.

It is therefore retracted within the guide body 12 and the piston 14 therefore has no effect on it. This is a first state of the component 10.

The spring bias means 64 bearing against the bush 63 engage the rib 62A of the control member 16 with the groove 62B in the piston 14.

The markers 59, 59' of the position indicator 50 are concealed.

If the control member 16 is depressed axially, as shown by the arrow F1 in FIGS. 1 and 7, it moves from its "out" position to its "in" position (FIGS. 2 and 8) and entrains with it the bush 63 and therefore the piston 14.

The piston 14 then projects slightly from the guide body 12 and causes the component 10 to move from its first state to a different second state.

Because the control member 16 entrains the bush 63, the lugs 43 on the bush 63 push aside the lateral branches 40 of the clip forming the part 21A of the hooking means 21 and hook onto the latter, which hold the bush 63 in the depressed position which, by virtue of the spring bias means 64, holds the control member 16 in its in position.

The lugs 60B of the position indicator 50 which is also entrained axially by the control member 16, travel along the helical grooves 60A in the retaining ring 20.

As the retaining ring 20 rotates with the guide body 12, this rotates the position indicator 50 about the spindle 19 of the control member 16, as shown by the arrow F2 in FIGS. 2 and 3.

At the end of this rotation the markers 59, 59' of the position indicator 50 are exactly aligned with the openings 57, 57' in the control member 16; they are therefore visible, as shown in FIG. 2.

The control member 16 must be unlocked before it can be returned to its out position to release the component 10.

Figure 8:
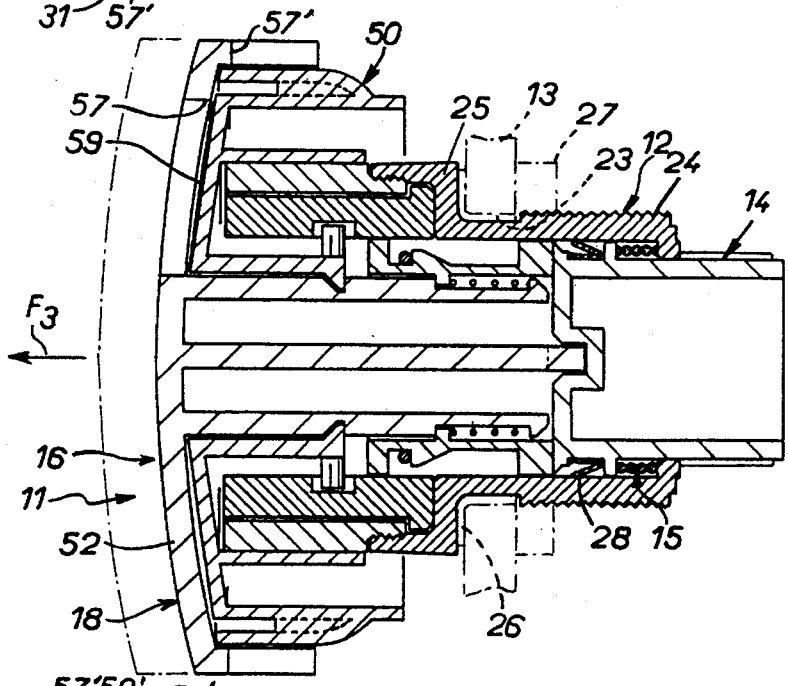
FIG. 8 is a similar axial section showing the control member in the in position.

To do this, sufficient traction must be applied to the control member 16 in the direction of the arrow F3 in FIGS. 2 and 8 to extract the rib 62A on the spindle 19 from the groove 62B in the piston 14, as shown in chain-dotted outline in FIG. 8.

The control member 16 must then be turned, as shown by the arrow F4 in FIG. 2, far enough for the lugs 43 of the bush 63, which are entrained by it, to escape from the lateral branches 40 of the clip constituting the part 21A of the hooking means 21. This movement is not possible until the control member 16 has been pulled out. When it has been released in this way, and due to the action of the return spring means 15, the bush 63 slides along the lateral branches 40 until its lugs 42 are again engaged with them, the control member 16 being entrained with it because of the action of the spring bias means 64.

On returning to its original axial position, the bush 63 is conjointly returned to its original angular position by the retaining ring 20, because of the cam means 22 operating between it and the latter, and it entrains with it the control member 16 which is therefore also returned to its original angular position.

Likewise, the position indicator 50 is returned to its original angular position by the retaining ring 20, by virtue of the cam means 60 operative between it and the latter.

The markers 59, 59' on the position indicator 50 are therefore concealed again.

Figure 9:
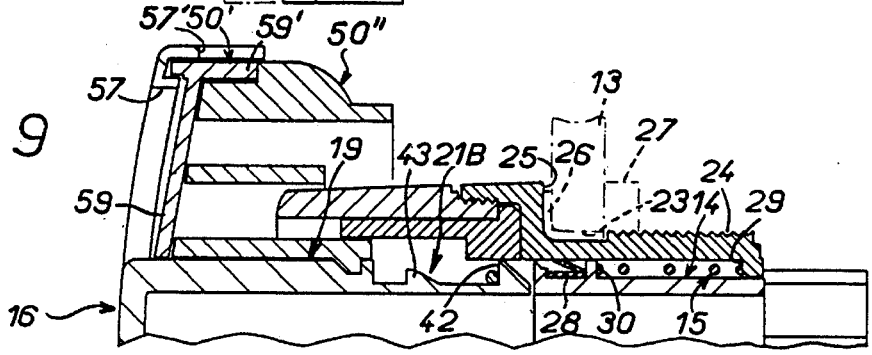
FIG. 9 is a partial axial section similar to FIG. 7 and relating to a first embodiment of the invention.

In the embodiment shown in FIG. 9 there are no locking means for the control member 16.

The lugs 42, 43 forming the part 21B of the hooking means 21 relating to the control member 16 are therefore carried directly by its spindle 19, in the usual manner, and the same applies to the helical ramps 47 (not visible in FIG. 9) forming the part 22B of the cam means 22 operative between the control member 16 and the retaining ring 20.

Figure 10:
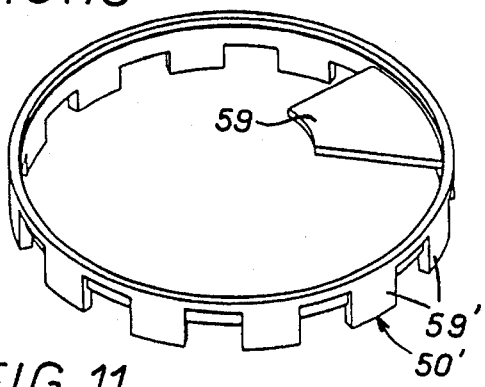
FIG. 10 is a perspective view of one component of this first embodiment.

In this embodiment, the position indicator 50 is in two parts 50', 50" fastened together and of different colors. The part 50', seen on its own in FIG. 10, contrasts with the other part 50" and forms the marker 59 and the markers 59'.

Other features are as previously described.

Figure 11:
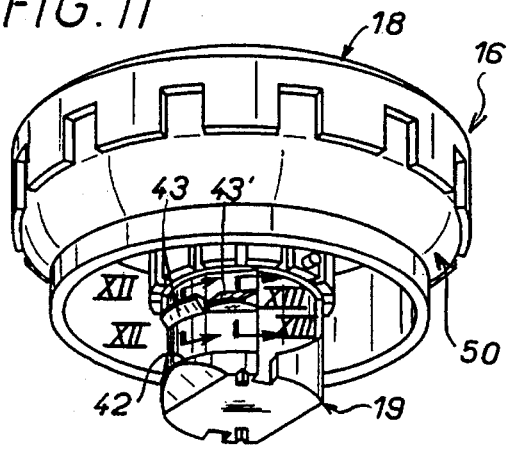
FIG. 11 is a perspective view of a second embodiment of the invention as seen from underneath.
Figures 12, 13:
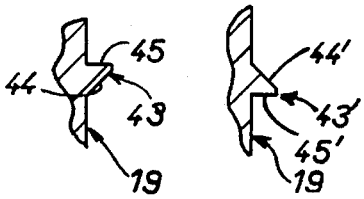
FIGS. 12 and 13 are views of parts of this second embodiment of the invention in axial section on the respective lines XII—XII and XIII—XIII in FIG. 11, to a larger scale.

In the embodiment shown in FIGS. 11 through 13 the locking means associated with the control member 16 include at least one further lug 43' projecting radially from the spindle 19 of the control member 16, alternating circumferentially with the lugs 43 that the spindle 19 includes as part of the part 21B of the hooking means 21 relating to the control member 16.

There are two further lugs 43' in practise, level with and adjacent the lugs 43.

In the opposite arrangement to the lugs 43, the additional lugs 43' have an oblique flank 44' at the same end as the head 18 of the control member 16 and a straight flank 45' at the opposite end.

To return the control member 16 from its "in" position to its "out" position, it must therefore first be turned sufficiently for its lugs 43 to escape from the lateral branches 40 of the clip constituting the part 21A of the hooking means 21, and then pulled out sufficiently for temporary elastic deformation of the lateral branches 40 to allow its additional lugs 43', engaged at this time with the lateral branches 40, to push the latter aside.

Figure 14:
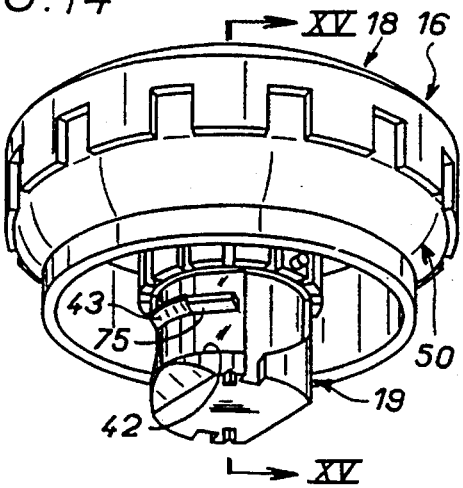
FIG. 14 is a perspective view of a third FIG. 1 and to a larger scale, showing the control member in the out position.
Figure 15:
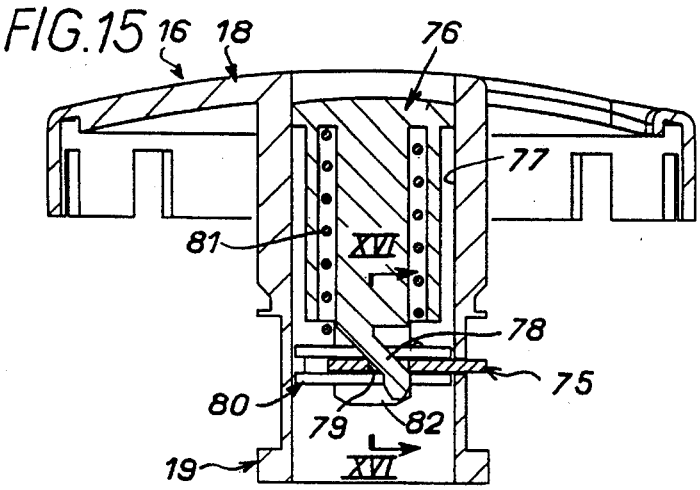
Figure 16:
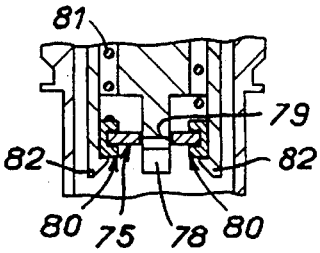
FIG. 16 is a view in axial section on the line XVI—XVI in FIG. 15.

In the embodiment shown in FIGS. 14 through 16 the locking means associated with the control member 16 include a key 75 moveable transversely on the spindle 19 of the control member 16 by a pushbutton 76 accessible to the user, between a deployed position in which it projects radially from the spindle 19, as shown in FIGS. 14 and 15, at the level of the lug(s) 43 of the latter forming part of the hooking means 21, and a retracted position (not shown) in which it is withdrawn into the spindle 19.

The pushbutton 76 moves axially in a bore 77 in the control member 16 which opens at its outside end onto the head of the latter and includes an oblique finger 78 engaged in a slot 79 in the key 75.

The latter slides in ribs 80 in one piece with and projecting transversely inside the spindle 19 and on which return spring means 81 bear, the return spring means being in practise a coil spring associated with the pushbutton 76.

The pushbutton 76 also has lateral lugs 82 shaped as hooks which, at rest, engage with the ribs 80 to limit its outward movement due to the action of the return spring means 81.

To return the control member 16 to its out position, as previously, it must first be turned sufficiently for the lugs 43 to escape from the lateral branches 40 of the clip constituting the part 21A of the hooking means 21; the pushbutton 76 is then depressed to move the key 75 from its deployed position in which it is engaged with one of the lateral branches 40 to its retracted position.

Other features are as previously described.

The present invention is not limited to the embodiments described and shown, but encompasses any variant execution and/or combination of their various component parts.

There is claimed:

1. Control button comprising a guide body adapted to be mounted on a support of any kind, a piston adapted to operate an underlying component of any kind and mobile in said guide body against return spring means, a control member mobile axially relative to said guide body between an "out" inoperative position and an "in" operative position and including a head for operation by a user and a spindle for operating said piston, and a retaining ring around said spindle of said control member, fixed axially relative to said guide body and prevented from rotating relative thereto, with, subordinate to said retaining ring, hooking means adapted to hold said control member releasably in its "in" position in respect to action applied thereto and cam means adapted to return said control member to an original angular position when released after being turned in its "in" position to disengage said hooking means, said control member being associated with a position indicator mobile between a retracted position when said control member is in its "out" position and a deployed position when said control member is in its "in" position and at least a portion of the control member being concealed in its retracted position and being revealed in its deployed position, said position indicator being rotatable about said spindle of said control member and including a hub disposed around and rotating on said spindle of said control member and keyed axially thereto, and a flange disposed under said head of said control member, said head of said control member having at least one localized opening in a path of movement of said flange.

2. Control button according to claim 1 wherein said flange of said position indicator forms a head at least in part complementary to said head of said control member.

3. Control button according to claim 1 wherein said head of said control member completely covers said flange of said position indicator.

4. Control button according to claim 1 wherein cam means for rotating said position indicator are provided between said position indicator and said retaining ring.

5. Control button according to claim 4 wherein said cam means include at least one helical groove on said retaining ring and at least one lug on said position indicator engaged with said helical groove.

6. Control button according to claim 1 wherein said head of said control member includes a plurality of circumferentially distributed openings and said flange of said position indicator includes the same number of markers on on a circumference defined by the plurality of openings.

7. Control button according to claim 6 wherein said head of said control member has a peripheral skirt with circumferentially distributed openings therein.

8. Control button according to claim 6 wherein said position indicator is of one piece construction.

9. Control button according to claim 6 wherein said position indicator is in two pieces fastened together and of different colors, one of which forms said markers.

10. Control button according to claim 1 further including locking means for releasably locking said control member in its "in" position in response to action applied thereto.

11. Control button according to claim 10 wherein said locking means include complementary nesting means operative axially between said spindle of said control member and said piston and wherein part of said hooking means relating to said control member is carried by a bush around said spindle of said control member and mobile on said spindle, with which it is constrained to rotate cooperating with spring bias means bearing on said spindle and spring-loading said bush towards a transverse shoulder on said spindle facing away from said head of said control member.

12. Control button according to claim 11 wherein said nesting means include a rib at the end of said spindle of said control member and a groove on said piston.

13. Control button according to claim 10 wherein said locking means include at least one additional lug projecting radially from said spindle of said control member and alternating circumferentially with said at least one lug of said spindle forming part of said hooking means.

14. Control button according to claim 13 wherein said additional lug has an oblique flank facing toward said head of said control member.

15. Control button according to claim 10 wherein said locking means include a key moveable transversely on said spindle of said control member by a pushbutton accessible to a user between a deployed position in which it projects radially from said spindle in line with said at least one thereof forming part of said hooking means and a etracted position in which it is withdrawn into said spindle.

16. Control button according to claim 15 wherein said pushbutton is mobile axially in a bore in said spindle of said control member which opens an outside surface onto said head thereof and includes an oblique finger engaged with a slot on said key.

* * * * *